US011105074B2

(12) United States Patent
Mock

(10) Patent No.: US 11,105,074 B2
(45) Date of Patent: Aug. 31, 2021

(54) SUPERVISORY UNIT WASHING FACILITY

(71) Applicant: Gjosa SA, Biel/Bienne (CH)

(72) Inventor: Elmar Mock, Biel/Bienne (CH)

(73) Assignee: GJOSA SA, Biel/Bienne (CH)

( * ) Notice: Subject to any disclaimer, the term of this patent is extended or adjusted under 35 U.S.C. 154(b) by 48 days.

(21) Appl. No.: 16/474,211

(22) PCT Filed: Dec. 22, 2017

(86) PCT No.: PCT/EP2017/084372
§ 371 (c)(1),
(2) Date: Jun. 27, 2019

(87) PCT Pub. No.: WO2018/122163
PCT Pub. Date: Jul. 5, 2018

(65) Prior Publication Data

US 2019/0352889 A1 Nov. 21, 2019

(30) Foreign Application Priority Data

Dec. 30, 2016 (CH) ..... 01763/16

(51) Int. Cl.

| | |
|---|---|
| ***E03C 1/046*** | (2006.01) |
| ***B05B 12/02*** | (2006.01) |
| ***B05B 12/14*** | (2006.01) |
| ***E03B 7/04*** | (2006.01) |
| ***E03C 1/05*** | (2006.01) |
| ***F24D 17/00*** | (2006.01) |

(52) U.S. Cl.
CPC ..... *E03C 1/046* (2013.01); *B05B 12/02* (2013.01); *B05B 12/14* (2013.01); *E03B 7/04* (2013.01); *E03C 1/055* (2013.01); *F24D 17/00* (2013.01)

(58) Field of Classification Search
CPC ..... E03C 1/046
See application file for complete search history.

(56) References Cited

U.S. PATENT DOCUMENTS 4,563,780 A 1/1986 Pollack
5,356,076 A * 10/1994 Bishop ..... B05B 7/0425 239/311

(Continued)

FOREIGN PATENT DOCUMENTS

CN 102292506 12/2011
CN 105423558 3/2016

(Continued)

OTHER PUBLICATIONS

International Preliminary Report on Patentability dated Jul. 2, 2019 (Jul. 2, 2019), Application No. PCT/EP2017/084372, 8 pages.

(Continued)

*Primary Examiner* — Nathaniel Herzfeld
(74) *Attorney, Agent, or Firm* — Rankin, Hill & Clark LLP

(57) ABSTRACT

A facility used for sanitation, cosmetics, and private or industrial cleaning includes a water supply, an outlet unit, a consumable unit and a control unit. The facility is a low through-flow rate facility. The control unit includes a sensor adapted to measure at least one value, a user interface unit adapted to enter a set-point and a closed loop control unit configured to adapt an operation parameter of the facility in consideration of the set-point.

12 Claims, 3 Drawing Sheets

(56) References Cited

U.S. PATENT DOCUMENTS

| | | | | |
|---|---|---|---|---|
| 5,681,400 | A * | 10/1997 | Brady | D06F 39/02 134/18 |
| 5,781,942 | A * | 7/1998 | Allen | G08B 21/245 4/623 |
| 8,162,236 | B2 * | 4/2012 | Rodenbeck | G05D 23/1393 239/390 |
| 9,982,420 | B1 * | 5/2018 | Romaine | E03C 1/055 |
| 2008/0301869 | A1 * | 12/2008 | Mock | E03C 1/046 4/615 |
| 2014/0027533 | A1 * | 1/2014 | Stiemsma | B65D 85/808 239/71 |
| 2014/0320291 | A1 * | 10/2014 | De Luca | G08B 21/245 340/573.1 |
| 2015/0308084 | A1 * | 10/2015 | Thompson | E03C 1/057 700/283 |

FOREIGN PATENT DOCUMENTS

| | | |
|---|---|---|
| EP | 2 543 779 | 1/2013 |
| WO | 2007/062536 | 6/2007 |
| WO | 2011/054120 | 5/2011 |
| WO | 2011/054121 | 5/2011 |
| WO | 2011/074018 | 6/2011 |
| WO | 2011/088436 | 7/2011 |

OTHER PUBLICATIONS

English translation of Chinese Office Action dated Jun. 9, 2020, Application No. 201780079475.6, 9 pages.

* cited by examiner

SUPERVISORY UNIT WASHING FACILITY

BACKGROUND OF THE INVENTION

Field of the Invention

The invention is in the field of facilities used for sanitation, cosmetics, and private or industrial cleaning. In particular, the invention concerns a facility with optionally an integrated supply for a consumable, such as a body care product or a cleaning agent.

SUMMARY OF THE INVENTION

It is an objective of the present invention to provide a facility for use in sanitation, cosmetics and/or cleaning applications that provides an improved quality of operation and improved results in the respective field of application.

A further possible objective of the present invention is to provide a facility for use in sanitation, cosmetics or cleaning that overcomes comparable state of the art facilities in terms of automatization and user-friendliness, at least.

A facility according to the invention is adapted for use in sanitation, cosmetics or cleaning.

Shower systems, systems for hand washing, taps, bathroom facilities and other sanitary installations are examples of facilities adapted for use in sanitation.

Equipment for beauty shops, such as coiffure shops, wellness but also equipment for private and commercial use, in particular for body care, hair care and/or for washing the human body, are examples for facilities adapted for cosmetics.

Facilities adapted for cleaning can be found in both private and commercial (for example hotel-) kitchens, but also in industry and devices used for cleaning of larger objects, such as floors, stairs, walls, cars etc. or parts thereof.

The facility according to the invention includes a water supply and an outlet unit. The facility is characterized by being a low through-flow rate facility and by including a consumable unit and a control unit. The control unit includes at least one sensor adapted to measure at least one value, a user interface unit adapted to enter at least one set-point and a closed loop control unit configured to adapt an operation parameter of the facility in consideration of the at least one set-point.

If a facility is a low through-flow rate facility or not, depends on its use of liquid per minute, in particular its use of water per minute. Often, authorities set demands for a facility being a low through-flow rate facility.

For example, a hand washing station or tap is a low through-flow rate hand washing station or tap, if the flow rate does not exceed 6 liters per minute. A shower is a low through-flow rate shower if the flow rate does not exceed 7.5 liters per minute. However, there is an increasing demand for a further reduction of flow rates and very efficient low through-flow rate hand washing stations, taps and showers do not disperse more than 2 liters per minute.

In an embodiment, the facility is equipped to disperse less than 10 liters per minute, in particular less than 7.5, 5, 4, 3 or 2 liters per minute.

In particular, the outlet unit of the low through-flow rate facility includes a nozzle set with at least two nozzles, wherein the nozzles are arranged for generating a spray of water droplets at a reduced flow rate. This is done by increasing the pressure of the water and creating two or more jets of water that collide with one another and thereby are atomized, creating the spray of droplets. For this purpose, the water pressure can be at least 10 bar or at least 15 bar or at least 20 bar.

Such nozzle sets are shown in WO 2007/062536 A2, WO 2011/054120 A2 and WO 2011054121 A2, for example. The publications are included by reference, hereby.

In embodiments, the consumable unit includes at least one of a reservoir equipped for storing a consumable and for filling the consumable into the reservoir and a holding device arranged to hold a container including the consumable. In particular, the holding device is arranged to allow for replacement of an empty container by a full container.

The consumable can be present as an additive that is mixed into a liquid, in particular into water.

A body care product, such as skin- and/or hair lotion, a shower gel or a shampoo, and cleaning agent, such as a soap, are examples of consumables.

It is an insight of the present invention that the use of a consumable unit and the mixing of a consumable into water circulating within and dispensed by the facility is most interesting in a low through-flow rate facility. Thanks to the low through-flow rate, the consumable mixed into the water and dispensed by the outlet unit rests for a longer time on the body part or object where it can take effect. In other words, the consumable is not rinsed away immediately. This leads to the further positive effect of a consumable consumption that is reduced significantly.

As pointed out above, the facility can be a low through-flow rate facility that is further equipped for increasing the water pressure, for example by including at least one pump that increases the pressure in at least one feeding conduit such that the water pressure in the feeding conduit is higher than in a feeding conduit of a facility that uses the water pressure delivered by the water (mains) supply. The water pressure in the feeding conduit can be at least 10 bar or at least 15 bar or at least 20 bar.

It is a further insight of the present invention, that an increased water pressure facilitates the mixing of a consumable into the water. In particular, an increase in water pressure leads to an increased velocity of the water or the water including the consumable and to increased turbulences in the water or the water including the consumable. Hence, the conditions for mixing the consumable into the water are improved.

The control unit is an electronic control unit, preferably. The closed loop control unit comprised by the control unit is configured to adapt an operation parameter of the facility by operating at least one actuator, such as pump or valve. In particular, the closed loop control unit is configured to follow the at least one set-point.

For example, the control unit is capable to mix a specific amount of consumable into a feeding conduit, wherein the specific amount depends on at least one of the flow rate within the feeding conduits, the flow rate of the liquid dispensed, the kind of consumable, a mode within a washing cycle, and a user input, for example.

The user interface unit comprised by the control unit includes at least one of:

- A display, e.g. for displaying a value measured by the at least one sensor comprised by the control unit.
- An input element and/or controls such as a button, in particular a button arranged such that a user can set a set-point, switch the value displayed, change settings of the facilities, select a mode and/or a cycle of the facility, change from a mode or cycle to another mode or cycle, stop a mode or cycle, skip a mode within a cycle, and/or navigate through a menu displayed on the display.

A touch screen, wherein the touch screen can take over some or all of the functionalities of the button, for example.

Temperature sensors, through-flow sensors, pressure sensors, distance sensors, motion sensors and image sensors are examples of sensors that can be comprised by the control unit.

The water supply can be provided by a local, for example public or mains, water supply. The water supplied by the local water supply can be warm and cold water or cold water only. In the case of cold water supply only, the facility can include a heater for heating water supplied to an elevated temperature.

The water supply can include a reservoir. In particular, the reservoir is refillable and includes a volume sufficient for performing at least one washing or cleaning cycle of the facility.

The reservoir can be in addition to the local water supply. In particular the reservoir is at least one of:

Refillable by the local water supply. In particular, the reservoir can supply the facility with water in cases when the facility is temporarily not connected to the local water supply, for example because the facility is a mobile facility.

A warm water reservoir, for example in cases when the facility is supplied by the local water supply or manually by cold water only and warm water is generated by the heater.

A dispenser, a shower head and a tap are examples of exemplary outlet units comprised by the facilities.

In an embodiment, the value measured by the sensor is at least one of an operation parameter of the facility, a characteristic of the water supply and a parameter characteristic of a user-facility interaction.

For example, the measured operation parameter is a temperature, a flux (flow rate) and/or a representative for the consumable used during an on-going current cycle of use and/or in total. Further, the measured operation parameter can represent a status of components of the facility, such as a shower being head mounted or not, a consumable container being present or not, an amount of the consumable contained in the consumable unit, etc.

Water hardness, water temperature, but also the existence or non-existence of a connection to the local water supply and/or the fill level of the reservoir are examples of characteristics of the water supply.

In an embodiment, the facility is equipped for touch-less user-facility interaction, for example by including a distance sensor, a motion sensor and/or an image sensor and by a control unit that is configured to analyze user behavior. In such an embodiment the value measured is a distance from the user to the facility and/or a gesture of the user, for example. In other words: the value measured is a parameter that is characteristic for the user-facility interaction.

In an embodiment, the control unit includes a communication unit, wherein the communication unit is adapted to up- and/or download data from a supervisory unit.

The supervisory unit is a unit remote from the facility. In other words: the supervisory unit is spatially or geographically distanced from the facility. The supervisory unit can be a single computer or a distributed system. The supervisory unit typically is configured to receive data from and/or send data to a plurality of facilities.

The data uploaded by the communication unit typically includes operational data, that is, data gathered by the control unit in the course of the operation of the facility.

Thus, the control unit can be configured to determine operational data, wherein the operational data can include at least one of data determined by the control unit alone, data determined by the control unit in combination with sensor data, data determined by the control unit in combination with user input data, and data determined by the control unit in combination with data downloaded from the supervisory unit, for example. Such operational data can include one or more of the following:

Duration of operation of the facility as a whole and of specific elements of the facility, such as pump, heater, etc. Such data can be determined by the control unit, since it controls the operation of such elements.

Frequency and/or duration of specific operation modes, such as "washing", "rinsing", "humidification", "purging", for example purging of conduits of the facility, etc., or operation programs, such as different types of treatment or washing cycles. Such data can be determined by the control unit as well.

Consumption of consumables and/or level of consumable in the reservoir or container and/or warning, if consumable is running low. Such data can be determined by the control unit, and/or by sensors for consumable flow or reservoir/container level.

Consumption of consumables in a single usage cycle and/or for a particular end user or customer.

In general, the different types of durations and frequencies can be related to one or more given time intervals, such as time since last maintenance, last month, last day, or any other time interval.

The operational data can further consider one or more of the following:

Identity of a customer. The operational data can consider characteristics of the customer, such as type of hair, but also allergies, preferred temperature etc. The identity and operational data can be determined by reading them from a data storage device carried by the customer, and/or by user interaction. Alternatively, the identity can be read from such a data storage device or by user interaction, and the operational data can then be retrieved from a database, given the customer's identity.

Identity of a professional performing a service using the facility.

The time of replacement actions, when consumables reservoirs have been refilled or containers have been replaced by full containers. Optionally, information on the type of consumable is included. Such data can be determined by sensors and/or by user interaction. The sensors can be arranged to read tags (e.g. optical or RFID tags) of the containers, which identify a type of consumable and/or describe properties of the consumable.

System failures and error messages. Such data can be determined by the control unit, and/or by sensors.

Data provided by the supervision unit, for example water-stress situation, external temperature, pollution level, obsolescence of the consumables communicated by the provider of the consumables.

In particular, the facility can perform a cycle that is specific for a customer or object identified. For example, the facility can identify the customer or object automatically or after a user input. The steps and operation parameters of the cycle are then downloaded from the supervisory unit. Hence, the customer or object is treated by any facility connected to the supervisory unit in the same way.

Further, the facility unit can upload adaption made to the cycle specific for the customer or object identified, such that the adaption can be considered automatically or after acceptance by the user or customer, next time.

The supervisory unit can be configured, based on the data from one or more facilities, to:

- Determine usage patterns and statistics for one or more facilities, estimate future consumption of consumables and optionally plan supply actions in order to replenish the supply of consumables at one facility or for a location where several facilities are located and operated.
- Plan maintenance operations for one or more facilities.
- Optimize operation of a facility or for a location where several facilities are located and operated.
- Determine a consumption of consumables in a single usage cycle and/or for a particular customer, in particular a listing of consumable used and the amount of each consumable used.
- Bill services performed by the use of one or more of the facilities.

The data downloaded by the communication unit are operation parameters, settings, settings in dependence of consumable used and/or updates, for example.

The downloaded data can also include information of interest for the user and/or customer, such as information about new consumables available, in particular new consumables that correspond to the type of consumable already used by the user and/or customer or consumables that complement to consumables and/or cycle(s) used by the user and/or customer.

It is further possible that the data downloaded by the communication unit is for advertising purposes.

One can also envisage that access to the supervisory unit is given to third parties in order to offer user or customer specific products and/or to analyze preferences, trends etc. of users and/or customers, for example.

Information stored, for example in the facility and/or the supervisory unit, can be adapted in dependence of at least one of:

- User feedback, for example user or customer satisfaction.
- User input made during the run of a mode or a cycle, for example changes in consumable used or the amount of consumable used, adaption in duration of a mode, temperature changes etc.
- Information about the user, customer or object to be treated with the facility, the information being detectable by a sensor, such as an image sensor, and/or detector. For example, the information can include information about the degree of contamination of the object, the kind of contamination, the dimensions and/or the shape of the object. The information can also include information generated out of a picture of the customer or user, for example its hair length.

In particular, the facility and/or supervisory unit is configured to store information from one or more previous sessions or usage cycles.

In an embodiment, the communication unit uploads data relevant for logistics.

For example, the communication unit uploads a facility identifier and at least one of consumption of consumables, level of consumable, running-low warnings and replacement actions.

The uploaded data can be used for taking action in order to supply the facility with consumable. The supply can be triggered automatically.

The operation parameters of the facility can be set in various ways. Depending on the concrete embodiment of the facility, they can be set by at least one of:

- A user input, in particular a user input entered by use of the user interface unit.
- Information downloaded from the supervisory unit, for example in reaction to a user input.
- Information stored in the facility. For example, the control unit can include a memory including a pre-scheduled cycle that is activated by a user input and/or a consumable detected in one or more consumable units.
- Information retrieved from an external source other than the supervisory unit, for example from a mobile phone of the customer or end user.
- Information concerning the user and/or customer being served by the user operating the facility.
- The consumable(s) present in the consumable units. The consumable(s) present in the consumable units can be set by a user input or by a sensor detecting a value characteristic for a consumable, for example a detectable symbol on the container including the consumable or an RFID-tag arranged connected or integrated in the container. Optical detectable symbols, such as barcodes and QR-codes are examples for detectable symbols.

In an embodiment, the facility is equipped to perform a plurality of modes and the control unit is configured to run the facility in the plurality of modes.

In particular, the facility is equipped to perform a humidification mode and/or a rinsing mode besides modes used for cleaning, washing and/or body-/hair-care, for example. Humidification can be used for moistening hair or hands before applying coloring agents or cleaning agents, or for moistening an object before applying a cleaning agent.

The facility can perform a mode that does not include dispersing a liquid. A drying mode and a detection mode, for example the detection of a contamination and/or kind of contamination of an object and the detection of a shape or size (of user, customer and/or object) are examples of such modes.

Modes can differ in at least one operation parameter, for example in at least one of flow rate, time dependence of the liquid dispensed, the spatial distribution of the liquid dispensed, the pressure of the liquid dispensed, and the kind and/or concentration of the consumable mixed in the liquid dispensed.

The mode that is performed by the facility can be dependent on a set-point, a user input, and/or downloaded data.

In an embodiment, the control unit is configured to run the facility in a cycle, wherein the facility is in at least two different modes during the cycle.

In particular, the facility is in a first mode to carry out a first step of the cycle and in a second mode to carry out a second step of the cycle.

A hair washing cycle, a hand washing cycle, a shower cycle and a cleaning cycle for an object are examples of cycles that can be run by the facility. Such cycles include the steps of wetting with water including or not including a consumable, washing or cleaning with water including a consumable and rinsing, for example.

A cycle can be a sequence of modes according to a routine stored in the facility or downloaded by the facility.

In addition or as an alternative, a cycle can be a logical sequence of modes. For example, selection or adaption of a specific mode by a user can result in one or more corresponding subsequent modes.

The subsequent mode can be adapted to the operation parameters of the previous mode.

For example, a mode for mixing/shampooing can initiate a mode for rinsing. The mode for rinsing can be adapted to the duration of the mixing/shampooing mode, the amount of consumable mixed in, the rate of consumable mixed in and/or the kind of consumable. The mode for rinsing can consider changes made by the user to any operation parameter of the previous mode.

An operation parameter of a mode or cycle can further be set automatically according to a detection mode or according to information given by the user. The information can include a degree of contamination, kind of contamination, characteristics of the object or body part to be treated, consumable in or inserted into the consumable unit etc.

In an embodiment, the consumable unit includes a reservoir for the consumable or is arranged for inserting the consumable contained in a container, wherein the consumable unit further includes a mixing device.

The container can be connected to the consumable unit by the use of a holding device in an exchangeable manner, for example.

In such embodiments, the value measured by the sensor can correspond to:

- an amount of the consumable flowing out of the consumable unit and via the mixing device into a feeding conduit; or
- a concentration of the consumable present in water flowing in the feeding conduit downstream of the mixing device.

In particular, the closed loop control unit operates an actuator, e.g. a valve, in accordance with the measured value, to control the amount or concentration to correspond to the set-point. The set-point depends on user input entered via the user interface unit and/or the kind of consumable, for example.

The sensor can be part of a measuring device.

The measuring device is equipped for controlling and limiting an amount of consumable that flows out of the reservoir or container towards other elements of the facility, in particular towards a feeding conduit.

The mixing device is arranged to mix a consumable that flows out of the reservoir or container into water flowing within the facility, in particular into the feeding conduit. The measuring and the mixing device can be implemented as an integrated measurement and mixing device.

The measuring device and/or mixing device can include at least one of a pump, such as a gear pump, a valve and a sensor, for example for measuring flow. The measuring device can include a counter and/or a timer.

The facility can include two, three, four or more consumable units, reservoirs or containers.

In particular, different consumables can be used for different modes. Further, different consumables can be used within a cycle.

Further, different consumables can be used within the same mode, either at the same time or one after the other.

In an embodiment, the facility includes a facility body.

In particular, the facility body is a sub-unit of the facility that includes the water supply, the consumable unit, some or all sensors of the control unit, some or all actuators and the closed loop control unit, for example.

The facility body can include the outlet unit. However, the outlet unit is movable relative to the facility body and in fluidic connection to the facility body via a tube, in most embodiments.

The user interface unit can be an element of the control unit that is one-piece or it can include separate parts.

In embodiments of the facility including the facility body, the user interface unit is, or parts of the user interface unit are, at least one of:

- integrated into the facility body;
- integrated into the outlet unit; and
- provided in a remote control unit that is separate from the facility body and the outlet unit.

The facility body can be mounted on the wall.

The facility body can include a box, wherein all elements of the facility body are provided in the box. The box includes supply openings, for example for water and/or consumable.

The facility body can further include a unit for collecting and guiding away waste water, for example a sink.

The remote control unit can be equipped for transferring data from the remote control unit to the closed loop control unit and vice versa. In particular, the remote control unit is equipped to send set-points and/or commands, for example in order to change the operating status of the facility, to the closed loop control unit and to receive measured values.

In an embodiment, the facility includes an outlet of a first kind and an outlet of a second kind, wherein the outlet of the first kind is a low through-flow rate outlet and wherein the outlet of the second kind is not a low through-flow rate outlet.

In addition, the outlet of the first kind can dispense liquid at an increased pressure, e.g. with a pressure of at least 10 bar or at least 15 bar or at least 20 bar, whereas the outlet of the second kind can dispense liquid at normal (mains) pressure. This means that the pressure dispensed by the outlet of the first kind can be actively increased, for example by a pump in the feeding conduit of the outlet of the first kind, whereas the pressure dispensed by the outlet of the second kind is a direct result of the pressure of the water supply.

The outlet of the second kind can be one of:

- A separate outlet unit in addition to the outlet unit of the low through-flow rate facility.
- An outlet of the outlet unit of the low through-flow rate facility. In this embodiment, the outlet of the second kind is generally off, except for very specific modes, such as modes for humidification and rinsing.
- A mode of an outlet that is equipped to operate with a low through flow-rate and optionally also at an increased pressure and, alternatively, to operate with a through flow-rate that is not a low through flow-rate and optionally also at normal pressure.

In an embodiment, the control unit is configured to perform a failure detection and a debugging routine.

For example, the control unit is configured to detect a missing supply of cold water, warm water and/or consumable, actuators that are performing out of specification, set-points that are out of a preset range and measured values that do not correspond to a given set-point and cannot be brought to the given set-point.

The debugging routine includes at least one of restarting and/or re-initialization of actuators and/or the control unit or parts thereof, e.g. a sensor or the closed loop control unit, displaying an error message and/or an instruction to the user for overcoming the bug and uploading an error message to the supervisory unit, for example.

In an embodiment, the outlet unit of the facility includes the nozzle set with at least two nozzles that are arranged to create two or more colliding (in other words: impinging) jets of water. The jet of water can include the consumable.

Each nozzle includes at least one nozzle opening through which the water or the water including the consumable is dispensed as a jet.

At least one nozzle opening can have a 3-fold rotational symmetry ($C_3$, a rotational symmetry of the order 3). In particular, the nozzle opening is not round.

The rotational axis is the longitudinal axis defining the nozzle opening, i.e. is the axis along which the jet is emitted essentially.

For example, the nozzle opening is trilobular.

The invention concerns a method for operation a facility for use in sanitation, cosmetics or cleaning according any of the above described embodiment, the method includes the steps of:

- Bringing a body part or object in a position relative to the facility. This step includes positioning the hands below a tap, entering a shower crucible, positioning a customer or bringing an object into a cleaning chamber.
- Mixing of a consumable into water circulating within a feeding conduit of the facility.
- Dispersing the water including the consumable in direction to the body part or object positioned relative to the facility.
- Rinsing of the body part or object.
- Compiling a report including information concerning the steps performed. The report can include at least one of: An identifier of the facility, an identifier of the customer or object treated, the steps of the cycle performed as well as characteristics of each step, such as kind and amount of consumable, temperature, adaptions done by the user or customer, warnings generated by the facility etc.

In an embodiment, the method further includes at least one of the steps:

- Computing operation parameters of a cycle based on data from a supervision unit, from user input and/or a detection mode. For example, the facility can download information concerning one or more previous sessions with cycles performed on a specific customer or object, such as the steps and the operation parameters of the previous cycle(s) or a preferred cycle. The operation parameters of the cycle computed can be based on input from the user itself and/or from a detection mode as described above.
- However, the facility or supervision unit can compute the operation parameters of the cycle based on user input and/or input from the detection mode, only.
- Uploading the report including information concerning the steps performed.

The method can further include at least one of:

- Performing a detection mode,
- wetting the body part or object,
- ramping up the consumable,
- changing the pressure and/or the flow rate of the liquid dispensed,
- checking for end-user or customer specific data, for example for his personal settings and/or preferences, and setting-up those data by retrieving the data and/or by entering the data into the facility. The data can be stored in the facility or in the supervisory unit, for example, and
- connecting the facility to a mobile device of the customer or user in order to transfer customer or user specific data.

BRIEF DESCRIPTION OF THE DRAWINGS

Exemplarily embodiments are shown in the following figures. In the figures, the same reference symbol is used for identical or comparable elements. The figures show.

DETAILED DESCRIPTION OF THE INVENTION

Figure 1:
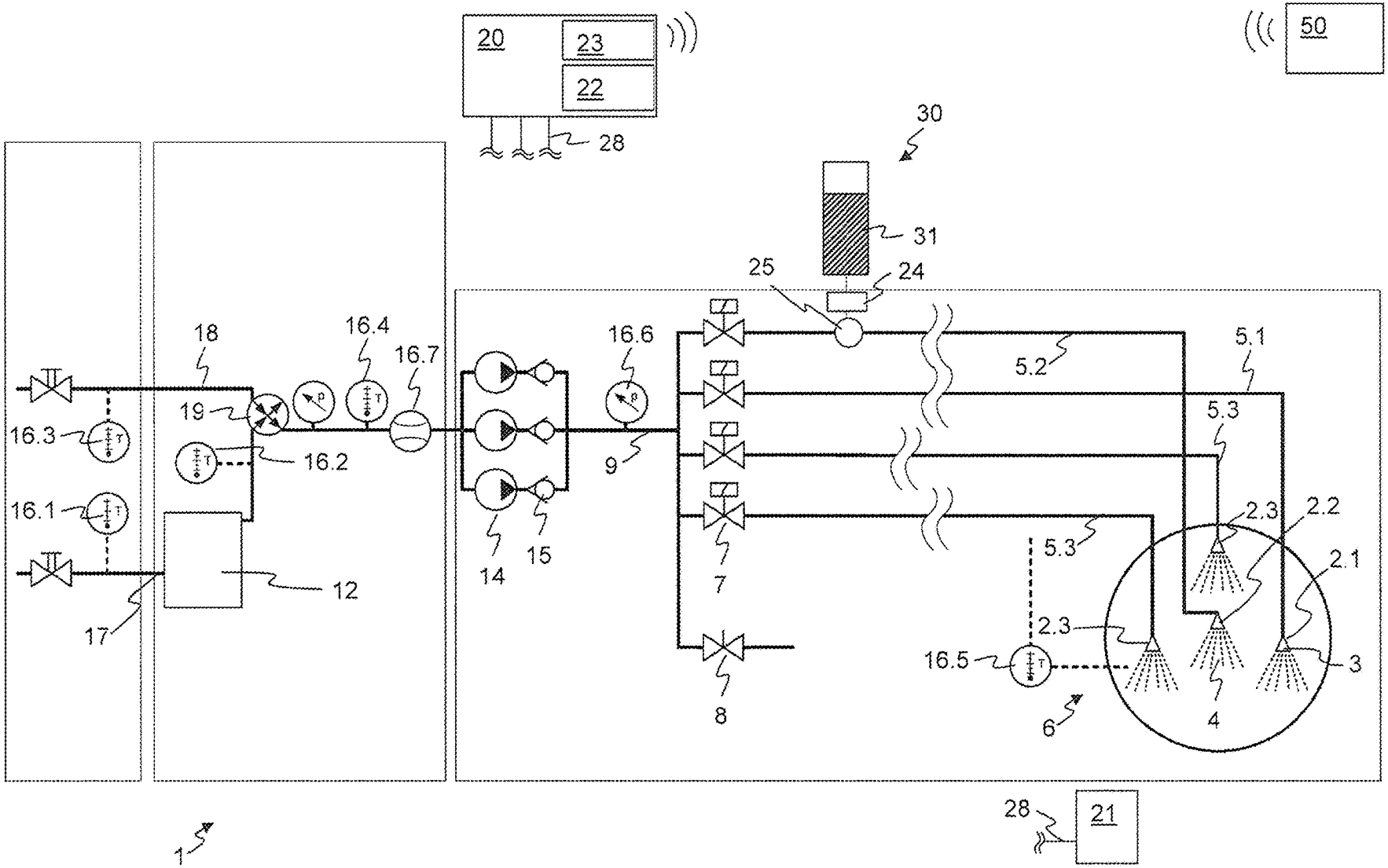
FIG. 1: A schematic representation of an exemplary operation principle of a facility.

FIG. 1 shows a schematic representation of an exemplary operation principle of a facility 1. The facility 1 includes an outlet unit 6 in which a first outlet 2.1, a second outlet 2.2 and further outlets 2.3 are arranged.

Each outlet includes one or more nozzle units 3 that are arranged to dispense a liquid 4.

A shower head or hand shower or an arrangement of liquid dispensing units arranged in a shower cubicle are examples of the outlet unit 6.

Each of the outlets is connected to an individual feeding conduit. The first outlet 2.1 is connected to a first feeding conduit 5.1, the second outlet 2.2 is connected to a second feeding conduit 5.2, and the each of the further outlets 2.3 is connected to further feeding conduits 5.3 that are separate for each further outlet 2.3.

The facility includes a consumable unit 30 that contains a consumable 31. In the embodiment shown, an outlet of the consumable unit 30 is connected to the second feeding conduit 5.2 by the use of a mixing device 25. A measurement device 24 that is arranged between the outlet of the consumable unit 30 and the mixing device 25 allows for setting, controlling and/or measuring an amount of consumable mixed into water flowing in the second feeding conduit 5.2.

Operation of the measurement device 24 and/or the mixing device 25 is done by a control unit 20.

Each of the feeding conduits originates from or is supplied from a general supply conduit 9.

In order to ensure a control of each outlet in a manner that is independent of the control of the other outlets, the feeding conduits include valves 7 that are configured to be operated, that is, turned on and off, individually.

Independent operating of the valves is done by the control unit 20.

Additionally, there can be a security or overpressure valve 8 on a conduit that runs parallel to the feeding conduits.

The general supply conduit 9 includes one or more pumps 14 capable to drive the pressure in the general supply conduit 9 to a value needed for the configuration of feeding conduits and outlets present. In general, a pressure between 10 and 30 bar, in particular a pressure around 20 bar is sufficient.

Depending on the number of outlets that are in operation, one or more or all of the pumps 14 can be turned on or off.

In other embodiments (not illustrated), instead of one or more pumps for the general supply and individual valves for the feeding conduits, there is an individual pump for each feeding conduit. In such embodiments, controlling of each outlet is effected by controlling the individual pumps.

The general supply conduit 9 includes a pressure sensor 16.6 arranged before the splitting of the general supply conduit 9 into the feeding conduits, immediately. The pressure sensor is part of a control loop for the pumps 14.

The general supply conduit 9 includes further check valves 15 arranged downstream of the pumps 14 and a flux sensor 16.7 arranged upstream of the pumps 14.

The general supply conduit 9 is configured to be fed from a local water supply.

As an optional feature, the facility 1 can include a heater 12. In such embodiments, feeding by cold water will be sufficient, even if there is need for dispensing a warm liquid 4 by at least one outlet. For this purpose, the heater 12 is arranged downstream of the point where the local cold water supply 17 connects to the washing device 1.

If both a local cold water supply 17 and a local warm water supply 18 are available, the facility 1 can include a connection to the local warm water supply 18 besides the connection to the local cold water supply 17, and further a thermostatic mixer 19 instead of the heater 12 or in addition to the heater 12.

The facility 1 includes a plurality of temperature sensors for a temperature management of the washing device 1:

- A first temperature sensor 16.1 measures the temperature supplied to the washing device 1 by the local cold water supply 17.
- A second temperature sensor 16.2 measures the temperature of the liquid immediately after or in the heater 12.
- A third temperature sensor 16.1 measures the temperature supplied to the washing device 1 by the local warm water supply 17.
- A fourth temperature sensor 16.4 measures the temperature in the general supply conduit 9.
- A fifth temperature sensor 16.5 measures the temperature dispensed by at least one outlet.

One or more of the temperature sensors can be omitted in dependence of the concrete realization of the warm water supply, in particular in the case of warm water supplied by the heater 12 only or in the case of warm water supplied by the local warm water supply 18 only.

Heater 12 and/or thermostatic mixer 19 as well as the temperature sensors are part of the control unit.

The control unit includes a closed loop control unit 22 and a user interface unit 21 in addition to the sensors and in addition to connections 28 to the measurement device 24, the mixing device 25, the valves 7, the pressure sensor 16.6 and the flux sensor 16.7. The control unit 20 implements the control loops for the liquid 4 dispensed and the control loop for the pumps 14.

Further, the control unit 20 includes a control loop for the temperature management, in particular for the liquid 4 dispensed by the outlets.

Figure 6:
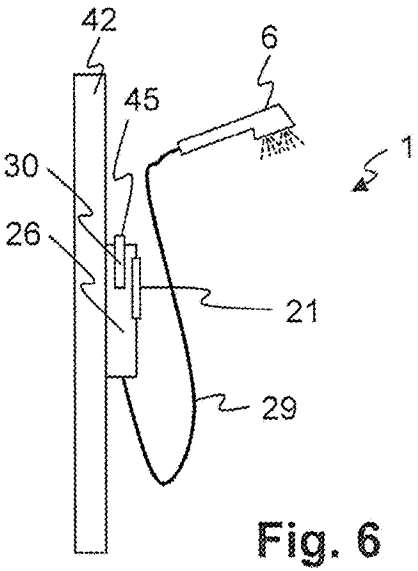
FIG. 6: A schematic representation of yet another exemplary facility.
Figure 5:
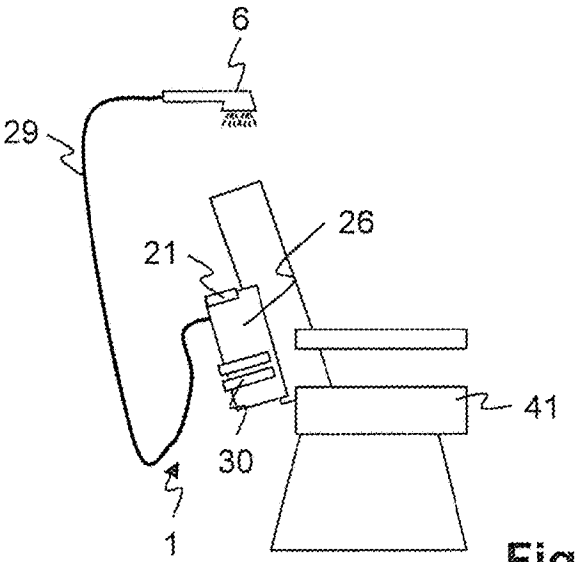
FIG. 5: A schematic representation of another exemplary facility.
Figure 4:
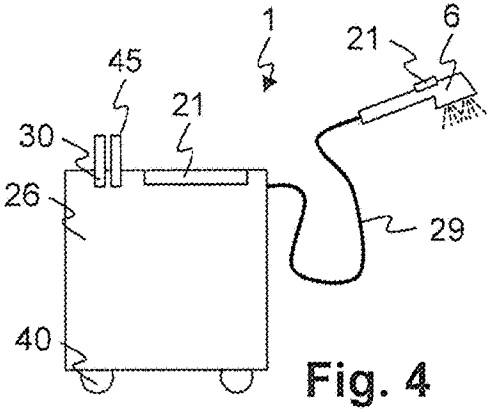
FIG. 4: A schematic representation of an exemplary facility.

The user interface unit 21 is arranged such that it is operable by a user in a comfortable manner. In particular, it is arranged such that a user using the facility 1 can operate the user interface unit 21 easily during usage of the facility 1. FIGS. 4-6 show examples of exemplary arrangements of the user interface unit 21.

The control unit 20 can include a communication unit 23 as an optional feature. The communication unit 23 is arranged to communicate with a supervisory unit 50, in particular to upload information gathered by the control loop 20 during operation and to download information stored in the supervisory unit 50, for example information uploaded by other facilities 1, settings and/or operation parameters.

Figure 2:
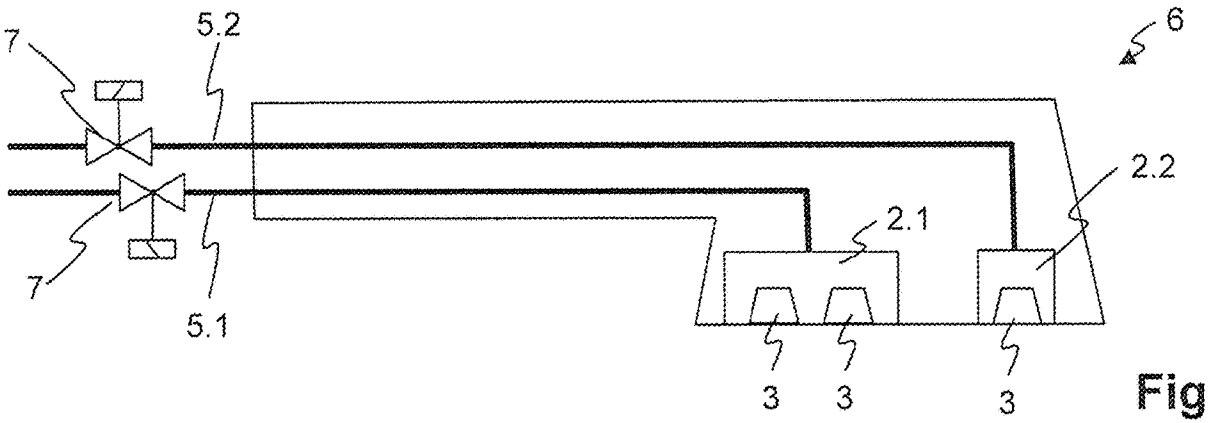
FIG. 2: A schematic representation of an outlet unit.

FIG. 2 shows a schematic representation of an outlet unit 6. The outlet unit 6 includes a first outlet 2.1 with a single nozzle unit 3 and a second outlet 2.2 with two nozzle units 3. The first outlet 2.1 and the second outlet 2.2 are configured to be fed independently through a first feeding conduit 5.1 and a second feeding conduit 5.2 respectively, each with an individual valve 7.

The outlet unit 6 can be configured to dispense water including the consumable 31 by one of the outlets, for example by the second outlet 2.2, and to dispense water without mixed in consumable 31 by the other outlet, for example by the first outlet 2.1.

However, one can envisage that both the first outlet 2.1 and the second outlet 2.2 are capable to dispense both water and water including the consumable 31, for example by a consumable unit 30 that is arranged at the general supply unit 9 feeding both the first feeding conduit 5.1 and the second feeding conduit 5.2. In such an embodiment, the concentration of consumable 31 dispensed by the outlets can be adjusted by the measuring device 24.

Independent of the concrete arrangement of the consumable unit 30, the measuring device 24 and/or the mixing device 25 can be arranged to switch in a state in which no consumable 31 is mixed into the water flowing in the facility 1.

In embodiments including the first outlet 2.1, the second outlet 2.2, and optionally further outlets 2.3, the control unit 20 can be configured such that the different outlets are controlled independently.

In particular the control unit 20 can be configured to run different outlets in different modes. The modes can differ in at least one of:

- The liquid 4 dispensed, i.e. the nature of the liquid 4 dispensed: For example, an outlet operating in a first mode can dispense water whereas an outlet operating in a second mode can dispense water including the consumable 31.
- The pressure of the liquid 4 dispensed. In particular, the pressure can be adapted to the liquid 4 dispensed and/or the pressure can be a pressure specific for a step within a washing cycle performed by the facility 1.
- The flow rate of the liquid 4 dispensed.
- The temperature of the liquid 4 dispensed.
- The time dependence of the liquid 4 dispensed: For example, the time dependence can include changing from or between different liquids 4 dispensed, pressures and/or flow rates. The changing can be continuous, stepwise and/or periodic. It can be characterized by a changing frequency, a period, limiting upper and lower values, e.g. with respect to the amount of consumable added, pressure and/or flow rate.
- It is further possible that not all of the outlets run in a mode that is time dependent. For example, only one or more outlets run in a mode that is time dependent.
- One can also envisage that at least one mode is a pulsed mode.
- A stream surface and/or shape of a jet generated by a nozzle present in a nozzle unit 3 (e.g. more focused).

Nozzle units 3 as shown in FIG. 2 are capable to reduce the through-flow rate of the liquid 4 dispensed significantly. For doing so, the nozzle unit 3 includes two or more nozzles arranged to generate impinging (or, in other words, colliding) jets.

A flow of droplets is generated where the jets impinge, wherein the amount of liquid needed to generate a flow of droplets that is sufficient for example to wet and/or rinse an object is reduced significantly, when compared to conventional washing devices.

In other embodiments, a nozzle unit 3 can include a single nozzle arranged to spray a liquid 4, or two or more such nozzles.

Figure 3:
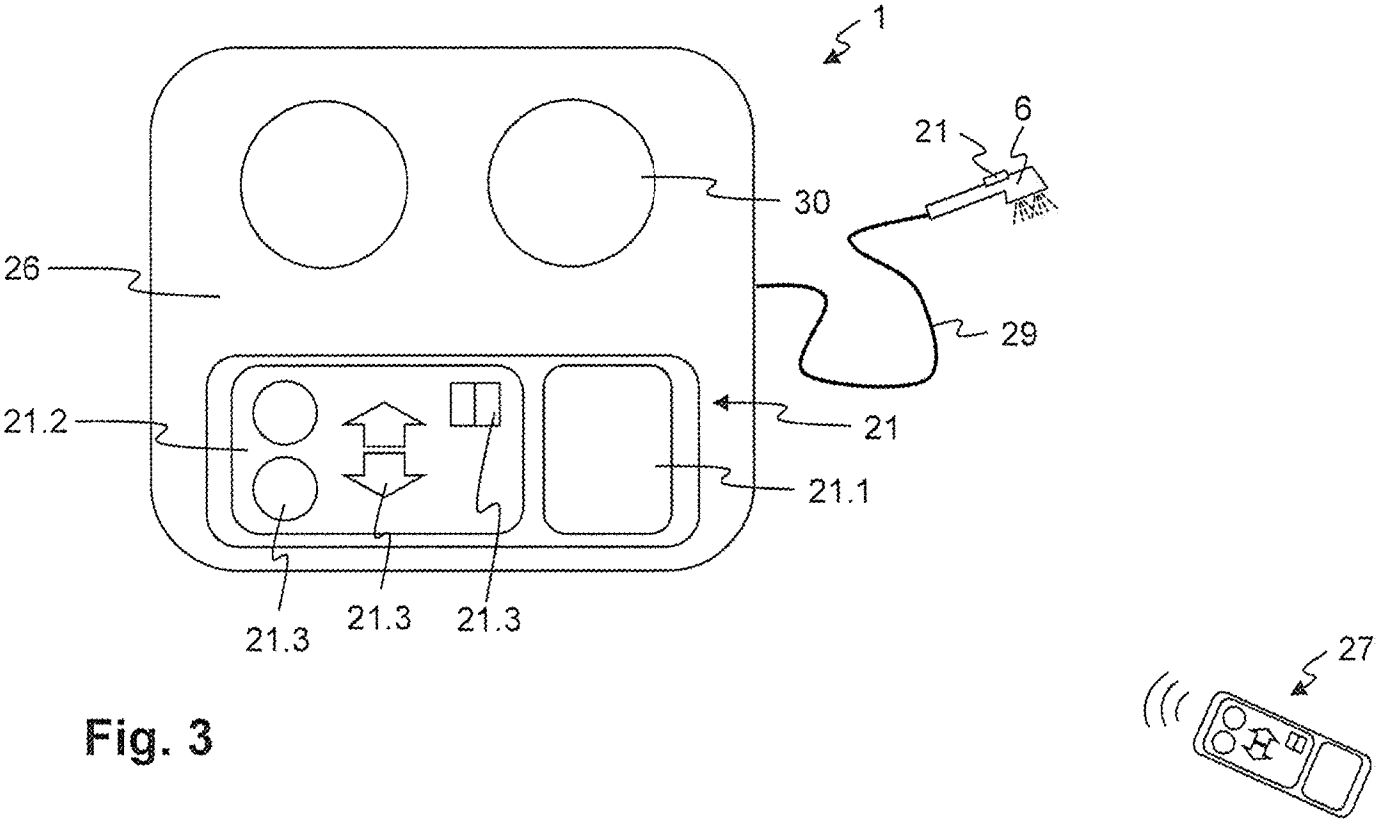
FIG. 3: A schematic top view of a facility showing an exemplary user interface unit in detail.

FIG. 3 shows a schematic top view of a facility 1 including an exemplary user interface unit 21.

The user interface unit 21 shown is arranged on a facility body 26.

In the embodiment shown, the outlet unit 6 is not an integral part of the facility body 26. However, the outlet unit 6 is in fluidic connection to the facility body 26 and the conduits comprised by the facility body 26 via a tube 29.

The user interface unit 21 shown includes a display field 21.1 and a control field 21.2.

Information that are helpful for the user are shown in the display field 21.1, for example the temperature of a liquid 4 dispersed, the kind and amount of consumable 31 added, the washing cycle performed currently, the running step within such a washing cycle, remaining time, but also information concerning the customer being served and/or the user operating the facility, or information for the customer and/or user.

The control field 21.2 includes controls 21.3, such as buttons, switches and touchscreens. The controls 21.3 are configured to effect, for example, one of the following actions upon operation of a control 21.3 by the user of the facility 1: setting or changing set-points, changing the operating status of the facility 1, switching between consumables 31 or adjusting the amount of a consumable 31 added, choosing or switching between programs, for example programs for washing cycles, skipping, repeating, shortening, enlarging steps of a washing cycle etc.

The embodiment of FIG. 3 shows the optional feature of a non-integral user control unit 21.

In the embodiment shown, a portion of the user control unit 21 is arranged on the outlet unit 6. In particular, the portion can include one or more of the controls 21.3.

However, on can also envisage to arrange the portion of the user control unit 21 or an additional portion of the user control unit 21 elsewhere, for example in reach of the customer, close to a place at which the user is during a washing cycle or on a movable remote control unit 27. The remote control unit 27 is shown in FIG. 3 as an optional feature.

FIGS. 4-6 show schematic representation of exemplary facilities 1. The shown facilities 1 include the facility body 26 and the outlet unit 6 that is connected to the facility body 26 via the tube 29.

The facility body 26 includes at least part of the user interface unit 21 and one or more consumable units 30 each of it containing a consumable 31.

In the embodiment of FIG. 4, the facility 1 is a movable unit by including wheels 40, for example.

Again, the optional feature of a portion of the user interface unit 21 arranged on the outlet unit 6 is shown.

The at least one consumable unit 30 is arranged at a horizontal surface of the facility body 26. The consumable unit 31 includes an opening, into which a container 45 including the consumable 31 can be slid in.

However, one can also envisage that the opening of the consumable unit 30 is an opening to a container reservoir internal to the facility body 26. In this case, the internal reservoir is re-Tillable via the opening.

FIG. 5 shows a chair 41 as used in professional coiffure- and beauty shops, for example. The facility body 26 is arranged on the back of the chair 41 and includes the user control unit 21 or a portion thereof on top of the facility body 26.

Each consumable unit 30 includes an opening into which a container including the consumable can be pushed in, again.

The water supply of the facility 1 is not shown. In chairs 41 that are mounted permanently, the water supply can be realized by conduits arranged within the chair 41.

FIG. 6 shows a facility 1 that is used as a shower device with the facility body 26 mounted to a wall 42 that forms part of a shower cubicle, for example.

The invention claimed is:

1. A facility used in sanitation, cosmetics or cleaning, wherein the facility comprises a water supply and an outlet unit, wherein the facility is a low through-flow rate facility and comprises a consumable unit and a control unit, wherein the control unit comprises a sensor adapted to measure at least one value, a user interface unit adapted to enter a set-point and a closed loop control unit configured to adapt an operation parameter of the facility in consideration of the set-point, wherein the consumable unit comprises a reservoir for a consumable or is arranged for inserting a consumable contained in a container, wherein the consumable unit comprises a mixing device, and wherein the value measured by the sensor corresponds to an amount of a consumable flowing out of the consumable unit and via the mixing device into a feeding conduit or to a concentration of the consumable present in water flowing in the feeding conduit downstream of the mixing device.

2. The facility according to claim 1, wherein the control unit comprises a communication unit, wherein the communication unit is adapted to up- and/or download data from a supervisory unit.

3. The facility according to claim 2, wherein the communication unit uploads data relevant for logistics.

4. The facility according to claim 1, wherein the facility is equipped to operate in a plurality of modes and wherein the control unit is configured to run the facility in said plurality of modes.

5. The facility according to claim 4, wherein the control unit is configured to run the facility in a cycle, wherein the facility is in at least two different modes during the cycle.

6. The facility according to claim 1, wherein the measured value is at least one of an operation parameter of the facility, a characteristic of the water supply and a parameter characteristic of a user-facility interaction.

7. The facility according to claim 1, wherein the facility comprises a facility body and wherein the user interface unit is at least one of integrated into the facility body, integrated into the outlet unit, and provided in a remote control unit that is separate from the facility body and the outlet unit.

8. The facility according to claim 1, wherein the facility comprises an outlet of a first kind and an outlet of a second kind, wherein the outlet of the first kind is a low through-flow rate outlet and wherein the outlet of the second kind is not a low through-flow rate outlet.

9. The facility according to claim 1, wherein the control unit is configured to perform failure detection and a debugging routine.

10. The facility according to claim 1, wherein the control unit is configured to determine operational data, wherein the operational data comprises at least one of data determined by the control unit, data determined by the control unit in combination with sensor data, and data determined by the control unit in combination with user input data.

11. A method for operating a facility according to claim 1, the method comprising the steps of:

bringing a body part or object in a position relative to the facility;

mixing of a consumable into water circulating within a feeding conduit of the facility;

dispersing the water comprising the consumable in direction to the body part or object positioned relative to the facility;

rinsing of the body part or object;

compiling a report comprising information concerning the steps performed.

12. The method according to claim 11, further comprising at least one of the steps:

computing operation parameters of a cycle based on data from a supervision unit, from user input and/or a detection mode;

uploading the report comprising information concerning the steps performed.

* * * * *